US011846144B2

(12) United States Patent
Charnaux Serta et al.

(10) Patent No.: US 11,846,144 B2
(45) Date of Patent: Dec. 19, 2023

(54) HANDLING LOADS IN SUBSEA OPERATIONS

(71) Applicant: Subsea 7 do Brasil Servicos Ltda, Niterói (BR)

(72) Inventors: Bernardo Botelho Charnaux Serta, Copacabana (BR); Irio Rodrigues Freire Neto, Niteroi (BR)

(73) Assignee: Subsea 7 do Brasil Servicos LTDA, Rio de Janeiro (BR)

( * ) Notice: Subject to any disclaimer, the term of this patent is extended or adjusted under 35 U.S.C. 154(b) by 83 days.

(21) Appl. No.: 17/268,432

(22) PCT Filed: Aug. 12, 2019

(86) PCT No.: PCT/BR2019/050328
§ 371 (c)(1),
(2) Date: Feb. 12, 2021

(87) PCT Pub. No.: WO2020/034019
PCT Pub. Date: Feb. 20, 2020

(65) Prior Publication Data

US 2021/0348454 A1 Nov. 11, 2021

(30) Foreign Application Priority Data

Aug. 14, 2018 (GB) ..... 1813261

(51) Int. Cl.
*E21B 19/00* (2006.01)
*B63B 27/16* (2006.01)
(Continued)

(52) U.S. Cl.
CPC ..... *E21B 19/002* (2013.01); *B63B 27/16* (2013.01); *B63B 35/03* (2013.01); *E21B 19/008* (2013.01); *E21B 33/038* (2013.01)

(58) Field of Classification Search
CPC ..... E21B 19/002; E21B 19/008; B63B 27/16; B63B 35/03
See application file for complete search history.

(56) References Cited

U.S. PATENT DOCUMENTS 4,702,320 A 10/1987 Gano et al.
6,729,802 B2 5/2004 Giovannini et al.
(Continued)

FOREIGN PATENT DOCUMENTS

EP 1 240 451 9/2002
GB 2522345 7/2015
(Continued)

OTHER PUBLICATIONS

API Specification 17J, "Specification for Unbonded Flexible Pipe," American Petroleum Institute, 2009.
(Continued)

*Primary Examiner* — Matthew R Buck
(74) *Attorney, Agent, or Firm* — Mattingly & Malur, PC

(57) ABSTRACT

A method of lowering a discrete load from a pipelay vessel comprises holding a rigid rod on an upright launch axis where the rod extends through a hold-back system; coupling a lower end of the rod to the load; connecting a wire to the load either directly or indirectly via the rod; operating the hold-back system to advance the rod downwardly, hence submerging the load, while the weight of the load is suspended from the hold-back system via the rod; when the load is under mater and beneath the splash zone, transferring the weight of the load directly or indirectly from the hold-back system to the wire; and continuing to lower the load in the water, suspended directly or indirectly from the wire. The method may be reversed to recover a load from a subsea location, such as when lifting a wellhead or blowout preventer from the seabed.

29 Claims, 16 Drawing Sheets

(51) Int. Cl.
*B63B 35/03* (2006.01)
*E21B 33/038* (2006.01)

(56) References Cited

U.S. PATENT DOCUMENTS

| | | | | |
|---|---|---|---|---|
| 8,056,492 | B2 * | 11/2011 | Roodenburg | E21B 19/002 114/51 |
| 8,950,977 | B2 * | 2/2015 | Cruickshank | F16L 1/26 405/173 |
| 8,950,997 | B2 | 2/2015 | Battersby et al. | |
| 9,664,307 | B2 * | 5/2017 | Cruickshank | F16L 1/14 |
| 9,671,042 | B2 * | 6/2017 | Mouchel | F16L 1/19 |
| 11,142,965 | B2 | 10/2021 | Bay | |
| 2003/0099515 | A1 * | 5/2003 | Giovannini | F16L 1/19 405/168.1 |
| 2003/0221602 | A1 | 12/2003 | Guinn et al. | |
| 2010/0038091 | A1 | 2/2010 | Sack | |
| 2011/0262229 | A1 * | 10/2011 | Tame | F16L 1/202 285/272 |

FOREIGN PATENT DOCUMENTS

| | | |
|---|---|---|
| WO | WO 88/01009 | 2/1988 |
| WO | WO 2010/081847 | 7/2010 |
| WO | WO 2012/120381 | 9/2012 |
| WO | WO 2018/097986 | 5/2018 |
| WO | WO 2018/111097 | 6/2018 |

OTHER PUBLICATIONS

API Specification 5L, "Specification for Line Pipe," American Petroleum Institute, Dec. 2012.

API Recommended Practice 17B, "Recommended Practice for Flexible Pipe," American Petroleum Institute, May 2014.

API Recommended Practice 1111, "Design, Construction, Operation, and Maintenance of Offshore Hydrocarbon Pipelines," American Petroleum Institute, Sep. 2015.

* cited by examiner

HANDLING LOADS IN SUBSEA OPERATIONS

This invention relates to handling loads in subsea operations, particularly to the challenges of lowering a load from the surface to a subsea location and of recovering such a load back to the surface. The invention relates especially to the problems of handling a heavy load when using a vessel that is not equipped with specialist heavy-lift equipment.

When installing, maintaining or decommissioning subsea oil and gas facilities, it is necessary to lower loads from the surface to a subsea location, usually on the seabed, and conversely to raise loads from a subsea location to the surface. Commonly, subsea operations involve laying pipelines and placing ancillary equipment such as wellheads or blowout preventers (BOPs) on or near the seabed. In this respect, pipelaying vessels generally comprise a working deck, winches, a service crane and a hold-back system such as tensioners or clamps for suspending a catenary of pipeline in water.

As winch systems do not conveniently allow loads to be lifted through the air from the deck of a vessel into the sea, some use of a crane remains necessary. However, small service cranes may not be capable of lifting bigger and heavier subsea structures such as wellheads or BOPs. Lowering such heavy loads in water may require the use of a separate crane vessel, which increases cost greatly and relies upon the availability of a suitable weather window.

As pipelaying vessels are available on field for pipeline installation, various proposals have been made to use the equipment that is already on board such vessels when lifting subsea loads. These proposals typically involve using pipelay equipment or a small crane to start lifting the load from the deck into the water and then handing over the load to a winch when the load is underwater. In general, a winch is more compact and can have higher capacity than a crane, and can be equipped with longer wires that can go deeper into the water. Several combinations of lifting equipment and pipelay equipment are known in the art but they often require complex operations to transfer the load underwater.

Before considering the prior art, it is helpful to understand what the terms 'rigid pipe' and 'flexible pipe' mean to those skilled in the art. Conventional rigid pipes used in the subsea oil and gas industry are specified in the American Petroleum Institute (API) Specification 5L and Recommended Practice 1111. A conventional rigid pipe usually consists of, or comprises, at least one pipe of solid steel or steel alloy. Rigid pipe joints are terminated by a bevel, a thread or a flange, and are assembled end-to-end by welding, screwing or bolting them together to form a pipe string or pipeline.

In recent years, the subsea oil and gas industry has begun to adopt rigid pipes of polymer composite materials as an equivalent to, or replacement for, conventional rigid pipes of steel. Composite pipes have a tubular load-bearing structure that is principally of composite materials. This is to be distinguished from pipes having a composite structure, such as various layered configurations that may be used in both rigid and flexible pipes. Typically, the composite material used in a composite pipe comprises a polymer resin matrix reinforced by fibres such as glass fibres or carbon fibres. The polymer matrix may be of thermoplastic or thermoset materials.

Whilst they have enough flexibility to bend elastically along a substantial length, rigid pipes and rigid composite pipes do not fall within the definition of flexible pipes as understood in the art. Flexible pipes used in the subsea oil and gas industry are specified in API Specification 17J and Recommended Practice 17B. The pipe body is composed of a composite structure of layered materials, in which each layer has its own function. In particular, bonded flexible pipes comprise bonded-together layers of steel, fabric and elastomer and are manufactured in short lengths in the order of tens of metres. Typically, polymer tubes and wraps ensure fluid-tightness and thermal insulation, whereas steel layers or elements provide mechanical strength. Conversely, unbonded flexible pipes can be manufactured in lengths of hundreds of metres but are very expensive and have limited strength.

Like-for-like, composite pipes are generally more pliant than conventional rigid pipes of steel and can be bent elastically to a smaller minimum bend radius. However, conventional rigid pipes and equivalent composite pipes share a characteristic of rigidity that is largely absent from flexible pipes, namely a capability to deflect elastically along their length and a tendency to straighten under elastic recovery. Thus, for the purposes of this specification, a rigid composite pipe or other rigid elongate member of composite material may be regarded as equivalent to a conventional rigid pipe or other rigid elongate member of steel, and both may be described as rigid or at least as non-flexible.

WO 2018/111097 teaches using a composite pipe as a substitute for the wire of a winch, with the tensioners of a pipelaying vessel being used to provide extra hold-back force. Whilst it is not a flexible pipe as that term is understood in the art, the composite pipe of WO 2018/111097 is spooled on a reel carried by the vessel and is substantially pliant and non-rigid. The composite pipe is directed though a pipelay tower of the pipelaying vessel and the load is suspended from the pipe. Major drawbacks of this solution include that it requires the use of a reel and that it requires a great length of very expensive composite pipe.

Similarly, WO 88/01009 discloses a method for lowering a wellhead from a drilling vessel by using a flexible pipe as a wire. Flexible pipe is also expensive and is mechanically weak, being prone to fatigue and damage. Additionally, a drilling vessel is expensive and its derrick is a huge support structure.

WO 2012/120381 also discloses the use of a flexible pipe to lower a load, in this case in abandonment and recovery (A&R) operations performed on a pipeline. The flexible pipe is supplemented by a parallel lifting wire, such that the flexible pipe and the lifting wire share the substantial load of the pipeline. The load of the pipeline may be handed over solely to the lifting wire at an intermediate depth where the load of the pipeline suspended above the seabed has reduced sufficiently. Similarly, in WO 2010/081847, a transfer and connection device is used to connect a winch and a crane to perform a dual-lift operation or to hand over a load between the crane and the winch.

Pliant, flexible load-bearing links—such as a wire, a flexible pipe as disclosed in WO 88/01009 and WO 2012/120381 or a highly-pliant composite pipe as disclosed in WO 2018/111097—can allow the load to clash with the hull of the vessel when the load is being lowered through a moonpool or over the side of the vessel. This is a particular risk as the load traverses the splash zone that typically extends up to 10 m to 30 m beneath the water surface, where water dynamics and wave motion can cause the load to swing dangerously.

Another problem is that the above prior art installation methods may not be straightforward to reverse for recovering a load from a subsea location back onboard a vessel. In this respect, it will be apparent that the load must also traverse the splash zone on its upward journey before being lifted from the sea. Also, as pliant load-bearing links such as wires, flexible pipes or highly pliant composite pipes will tend to deflect under the influence of sea dynamics, it may be challenging to connect a load to them underwater.

GB 2522345 discloses the use of J-lay equipment to assist in abandonment and recovery of pipelines. An abandonment string attached to an end of a pipeline is assembled from multiple tendon elements, which are added successively to the top of the abandonment string in a J-lay tower as the end of the pipeline is lowered in the sea. When the end of the pipeline reaches a handover depth, the load of the pipeline is transferred from the abandonment string to a winch wire, which completes the abandonment operation. The abandonment string is then disassembled as it is raised back through the J-lay tower.

The solution described in GB 2522345 is advantageous for A&R operations performed on pipelines but is complex and inappropriate for lowering discrete, smaller loads such as wellheads or BOPs. It also requires the presence of a vessel that is configured for J-lay operations.

US 2010/038091 describes a system for deploying a subsea well intervention system and a spoolable compliant guide (SCG) in a single stage from a surface vessel to a subsea location via a moon pool.

WO 2018/097986 teaches a method of lowering a subsea component to a subsea location without the requirement of a moon pool. The subsea component is lowered by a deployment frame that is cantilevered over the edge of a vessel.

Against this background, the invention provides a method of lowering a load from a pipelay vessel floating on the surface of a body of water. The method comprises: holding a rigid rod on an upright launch axis, extending through a hold-back system on a pipelay tower of the vessel; mechanically coupling a lower end of the rod to the load, preferably rigidly; connecting a wire to the load directly or indirectly, preferably above the surface; operating the hold-back system to advance the rod downwardly relative to the pipelay tower, hence submerging the load, while the weight of the load is suspended from the hold-back system via the rod; when the load is underwater, transferring the weight of the load from the hold-back system to the wire; and then continuing to lower the load in the water, suspended from the wire.

The weight of the load is advantageously transferred from the hold-back system to the wire when the load reaches, or is at, a predetermined depth underwater, it being understood that this depth is typically less than 100 m. In this respect, the splash zone typically extends up to about 30 m deep; as long as the load is within the splash zone, the rod is the primary lifting interface.

Conveniently, the hold-back system may be used to hold the rod on the upright launch axis before coupling the rod to the load. In that case, the hold-back system may be operated to advance the rod toward the load for coupling the lower end of the rod to the load.

The load may be moved transversely relative to the launch axis before coupling the lower end of the rod to the load. For example, the load may be supported on a skid or on a moonpool hatch that is movable relative to a deck of the vessel.

The wire is preferably connected to the load before the hold-back system is operated to advance the rod.

The weight of the load may be transferred from the wire to a secondary wire when the load is underwater.

The wire may be connected to the load indirectly via the rod, so that the load is suspended from the wire via the rod. In that case, the rod may be detached from the load when the load has been lowered to a subsea location, and the detached rod may then conveniently be recovered to the vessel by winding in the wire. In particular, the detached rod may be lifted back to a position in which the rod extends through the hold-back system.

In another approach, where the wire is suitably connected to the load either directly or otherwise not via the rod, the load may be detached from the rod underwater while the rod is held by the hold-back system. In that case, the hold-back system may then be operated to retract the detached rod upwardly relative to the pipelay tower.

The wire is preferably tensioned while the rod is held by the hold-back system. The tensioned wire may extend substantially parallel to the launch axis or substantially along the launch axis.

The method of the invention is apt to be performed using a flex-lay vessel. The launch axis may extend through a moonpool of the vessel, or over the side of the vessel.

In a preliminary operation, the rod may be moved from a stowed position to a ready position extending through the hold-back system along the upright launch axis. The rod may, for example, be tilted into an upright orientation by lifting an end of the rod from a position lying horizontally on a working deck of the vessel. Alternatively, the rod may be lowered into the water before connecting the wire to an end of the rod underwater and winding in the wire to lift the rod into the ready position.

The inventive concept extends to corresponding methods of recovering a load from a subsea location to a pipelay vessel on the surface of the sea.

One recovery method comprises: winding in a wire suspended from the vessel to lift a rigid rod that is attached to the wire and mechanically coupled to the load to a position extending through a hold-back system on a pipelay tower of the vessel; when the load is underwater, engaging the hold-back system with the rod to transfer the weight of the load from the wire to the hold-back system; and operating the hold-back system to retract the rod upwardly relative to the pipelay tower, lifting the load above the surface, while the weight of the load is suspended from the hold-back system via the rod. These recovery operations may follow the steps of suspending the rod underwater on the wire and mechanically coupling the rod to the load at the subsea location.

Another recovery method comprises: winding in a wire suspended from the vessel to lift a load attached to the wire toward the vessel; underwater, transferring at least part of the weight of the load from the wire to a hold-back system on a pipelay tower of the vessel by mechanically coupling the load to a lower end of a rigid rod that is engaged with the hold-back system; and operating the hold-back system to retract the rod upwardly relative to the pipelay tower, lifting the load above the surface, while at least part of the weight of the load is suspended from the hold-back system via the rod. These recovery operations may follow the step of attaching the wire to the load at the subsea location.

Either of these recovery methods may be preceded by transferring the weight of the load to the wire, underwater, from a secondary wire used to raise the load from the subsea location.

The recovery methods may further comprise: detaching the wire from the rod or the load aboard the vessel; detaching the load from the rod aboard the vessel; and/or removing the rod from the pipelay tower and stowing the rod.

The hold-back system is preferably a tensioner system that is operated by turning endless tracks that engage the rod, or may be or comprise a friction clamp that is able to travel along the pipelay tower and engages the rod by friction. The wire suitably extends through the hold-back system.

The inventive concept also embraces a device for hoisting a load underwater from a pipelay vessel. The device comprises a substantially rigid rod, preferably no greater than 70 m in length, that has, at an end, a mechanical connector arranged to connect directly to the load. The mechanical connector is preferably arranged to connect rigidly to the load, thus preventing the load pivoting relative to the rod about an axis that is transverse to the length of the rod. The rod may further comprise a wire connection at an end opposed to the mechanical connector, to connect to at least one lifting wire.

The rod preferably has a substantially constant diameter extending along substantially its entire length, and more preferably is in a single continuous piece. The rod suitably has a surface state, texture or shape that is arranged to allow, or to facilitate, frictional gripping by a pipe hold-back apparatus of the pipelay vessel.

Exemplary embodiments of the invention implement a method for lifting and lowering a heavy load from a pipelay vessel into water. Preferably the vessel is a flexible pipelay or 'flex-lay' vessel. Flex-lay vessels are capable of installing flexible flowlines and risers, umbilicals and power cables. They are characterised by a substantially vertical ramp or tower that is equipped with one or more tensioners and an alignment chute or wheel on top. Some flex-lay systems can be adapted to perform J-lay or reel-lay operations.

The method implemented by the embodiments to be described comprises the following steps: preparing a rigid rod such as a pipe string; inserting the pipe string into the firing line or onto the launch axis of a pipelay tower; gripping the pipe string by a pipe-gripping means of the pipelay tower, such as a track tensioner and/or friction clamps; mechanically coupling a lower end of the pipe string to the load; starting to lower the load into the water by using the pipe-gripping means; handing over the load to a winch; and continuing to lower the load using a wire of the winch.

The load may be lowered through a moonpool of the vessel or may be lowered over a side of the vessel.

The winch wire may be connected to an upper end of the pipe string, which may be shorter than the pipelay tower. The pipe string may be uncoupled from the load and recovered after the load is installed at a destination, or may be uncoupled from the load and recovered after handing over the load to the winch. The winch wire could be connected to the load instead of to the top of the pipe string.

The winch wire may be connected to the load or to the pipe string before lowering begins, or may be connected to the load or to the pipe string when the upper end of the pipe string reaches the pipe-gripping means.

The winch or a sheave that supports the winch wire can be positioned at any suitable location on the vessel, including on a structure that can be displaced above a moonpool once the load has passed through. There can also be one or more subsequent handovers to other winches or to a crane or to a heave-compensated hoisting means for performing final landing of the load at a subsea location such as the seabed.

The load may be preinstalled on a movable platform such as a hatch of a moonpool that slides below the load for opening. The load may instead be mounted on a skid that is moved over the moonpool or otherwise relative to a deck of the vessel for connection to the pipe string.

More generally, the invention involves the use of a structure installation tool that comprises a mechanical connector and an elongate structure such as a pipe. The tool is moved above a workstation by a crane lift or by deck handling, which need not involve lifting the tool overboard. The structure to be installed is moved to a working table of the workstation, for example on a skid or a pallet. The tool is then connected and locked to the structure, for example to a hub or socket on the structure.

Next, after taking the weight load of the structure and the tool with a tensioner system, a moonpool hatch or door or other structure supporting the load is opened or moved aside, or a supporting skid or pallet is pulled aside from below the load. The pipe is then advanced by turning the tracks of the tensioner system to lower the structure into the sea, for example through the moonpool. The structure is deployed through the splash zone and the load of the tool and the structure is transferred to an A&R winch, whereupon the load is lowered further on an A&R wire. Optionally the load is then transferred to a crane of the vessel. The structure is installed on reaching a subsea target location, preferably with the assistance of active heave compensation applied by a winch or by a crane as appropriate.

In summary, the invention provides a combination of innovative tooling and methodology for installing subsea structures such as wellheads, BOPs, Christmas trees and other temporary or permanent equipment. The invention employs a rigid pipe section of steel or rigid composite material, joined to a subsea connector by a flanged or welded connection. The pipe section can be supported and advanced along the launch axis by the tensioner system of a pipelaying support vessel (PLSV) and may extend through a moonpool of such a vessel.

An advantage of the invention is to enable the use of flex-lay vessels for lowering packages of, say, 50 Te to 100 Te weight that are too large and heavy for their cranes to handle effectively, but too small and light to justify using an expensive heavy-lift vessel or a drilling rig.

By using a tensioner system to support a rigid pipe/connector system, the invention enables safe and controlled deployment and recovery of a subsea structure through the splash zone. The invention also enables deployment and recovery of the structure through a sheltered moonpool. These factors allow subsea operations to progress with fewer weather restrictions.

As the tensioner system provides fine control over the vertical alignment of the subsea structure, the invention enables safe stack-up mounting of subsea equipment onboard the vessel for installation together as a unit.

The invention also allows easy access underneath a subsea structure or equipment before installation. This facilitates pre-deployment servicing, testing and checking of systems, such as those in instrumented wellhead equipment.

The invention provides a cost-effective solution that requires neither complex subsea equipment support vessel (SESV) equipment nor long drill pipe and rig vessels. The solution of the invention is safer and simpler than relying solely upon a crane supported by subsea ROV intervention. In comparison to the use of a crane for overboarding a load, the invention allows better control of the operation, improves the deck layout and enables easier and safer recovery in case of contingency.

The invention may therefore be summarised as a method of lowering a discrete load from a pipelay vessel, which method comprises: holding a rigid rod on an upright launch axis where the rod extends through a hold-back system; coupling a lower end of the rod to the load; connecting a wire to the load either directly or indirectly via the rod; operating the hold-back system to advance the rod downwardly, hence submerging the load, while the weight of the load is suspended from the hold-back system via the rod; when the load is underwater and beneath the splash zone, transferring the weight of the load directly or indirectly from the hold-back system to the wire; and continuing to lower the load in the water, suspended directly or indirectly from the wire. The method can be reversed when recovering a load from a subsea location.

In order that the invention may be more readily understood, reference will now be made, by way of example, to the accompanying drawings in which.

Figure 1:
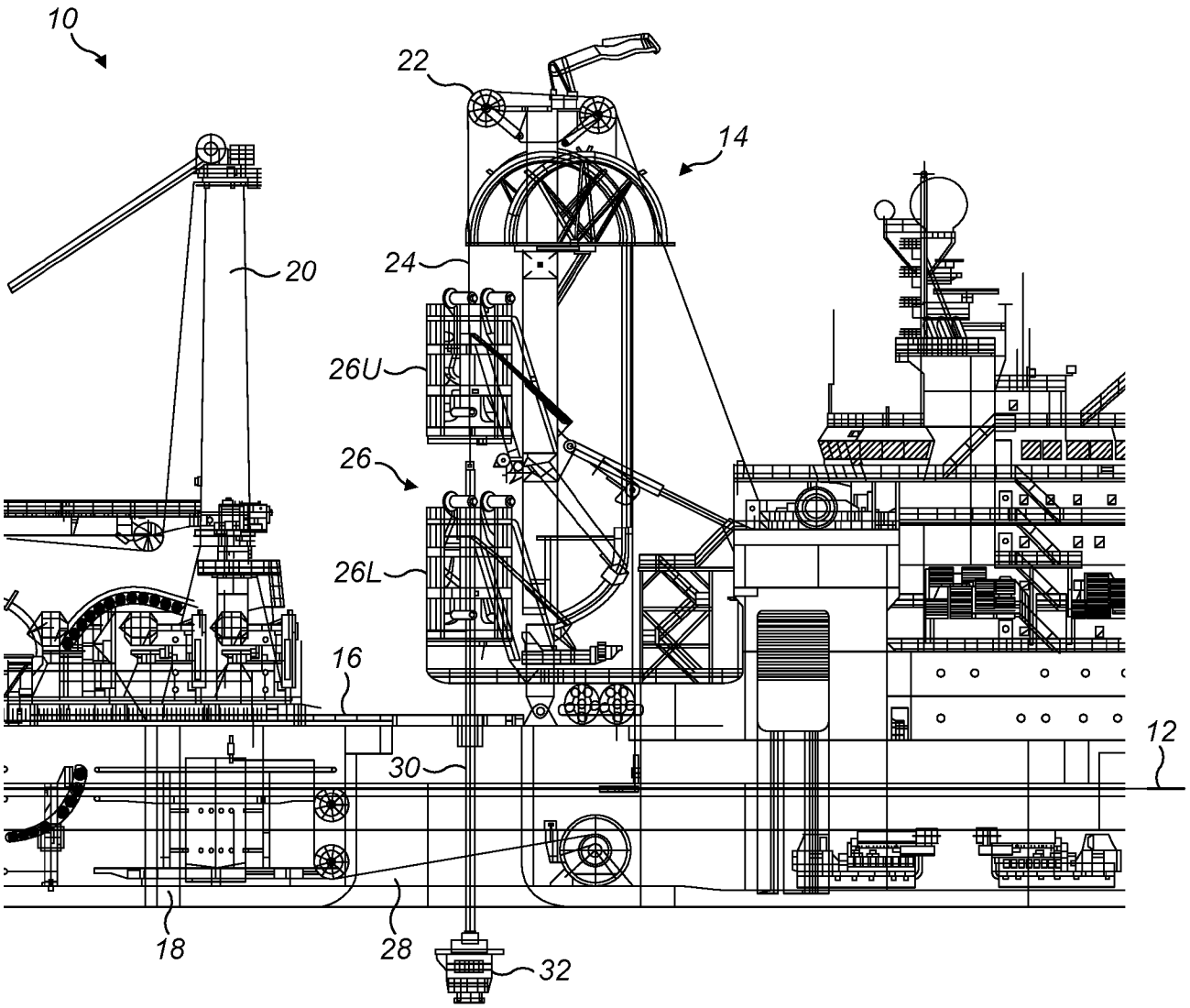
FIG. 1 is a side view of a flex-lay vessel in the process of lowering an item of subsea equipment into the sea, the equipment being attached to a lower end of a rigid rod in accordance with the invention.
Figure 4A:
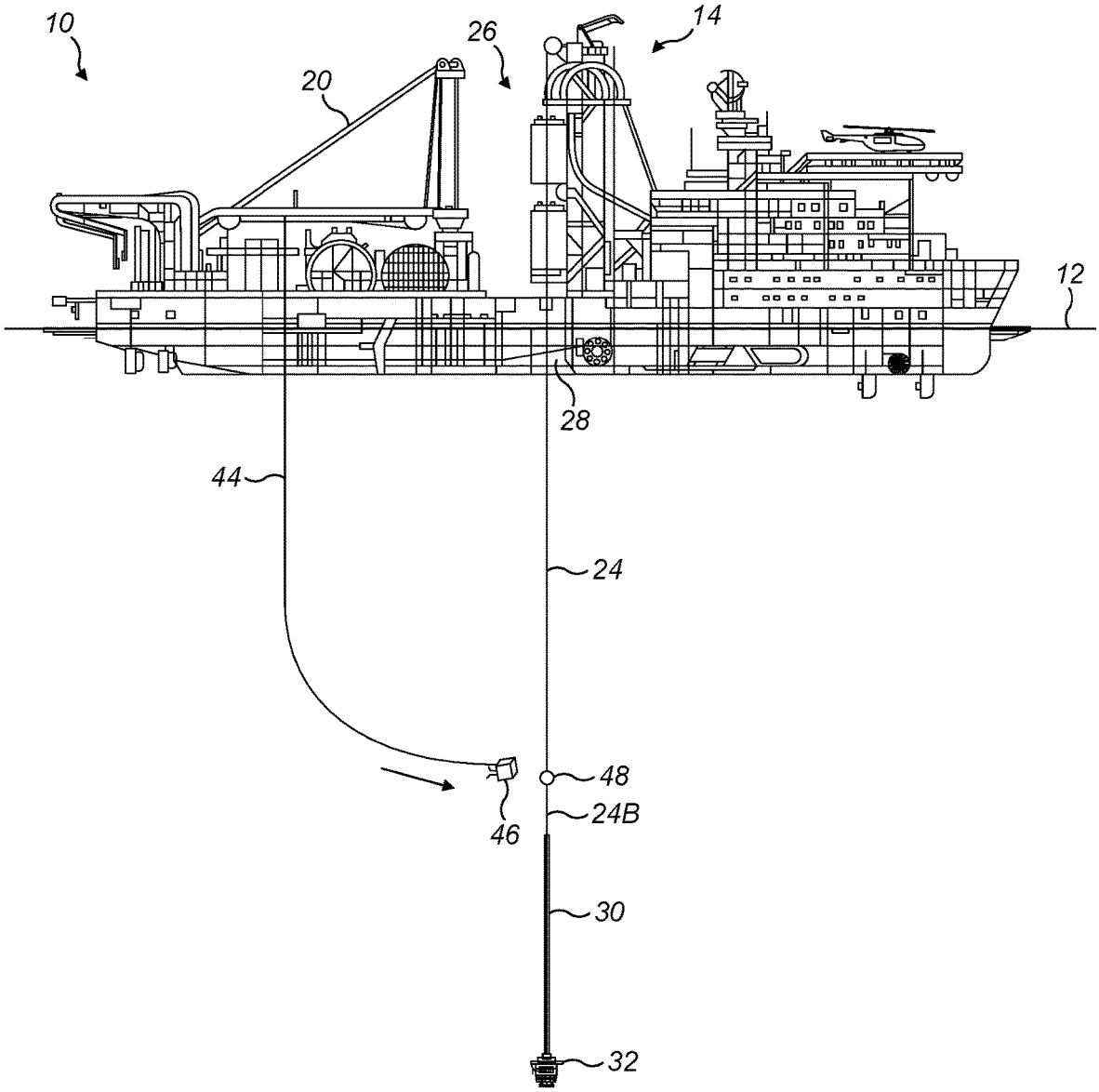
Figure 4B:
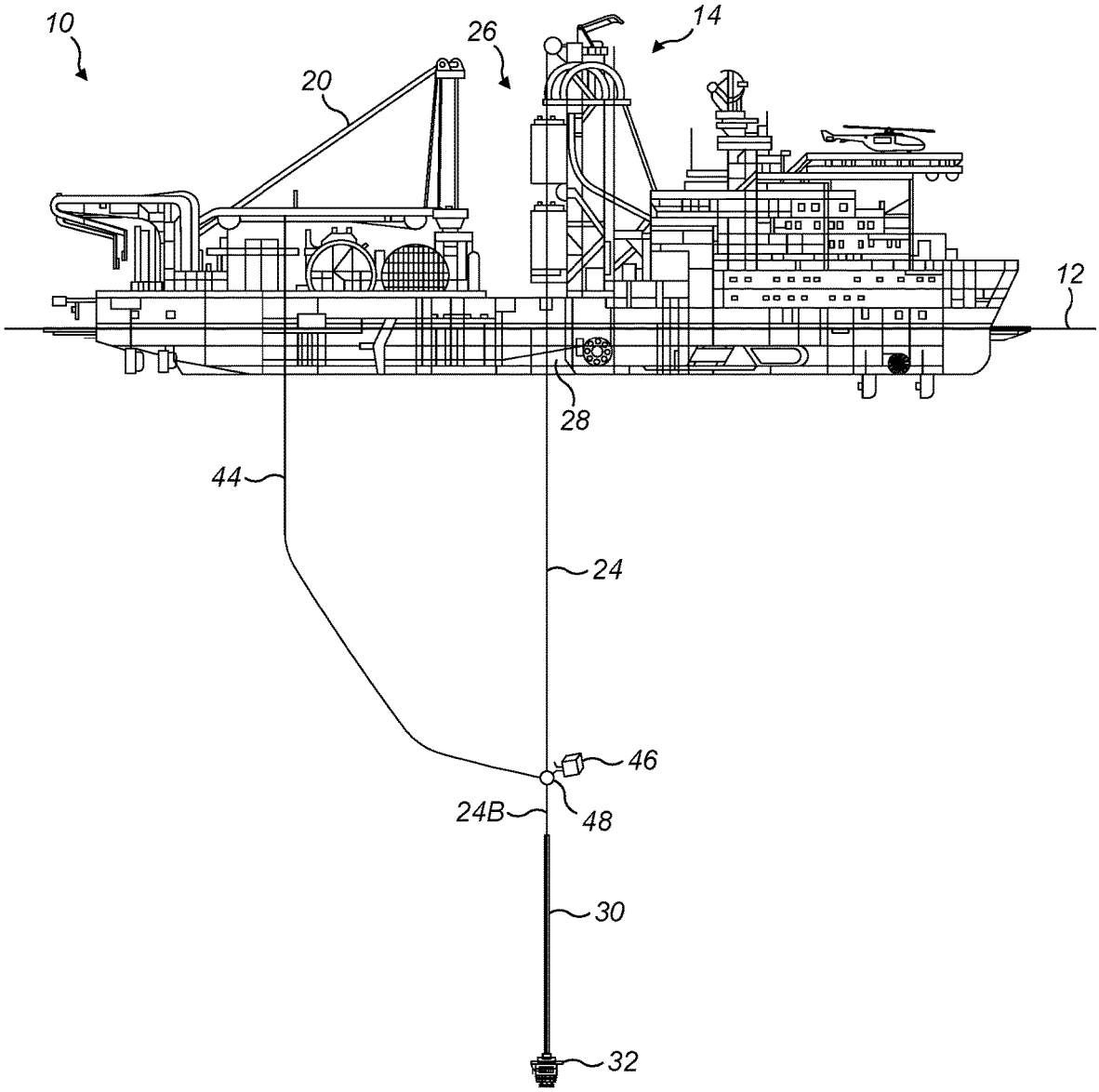
Figure 4C:
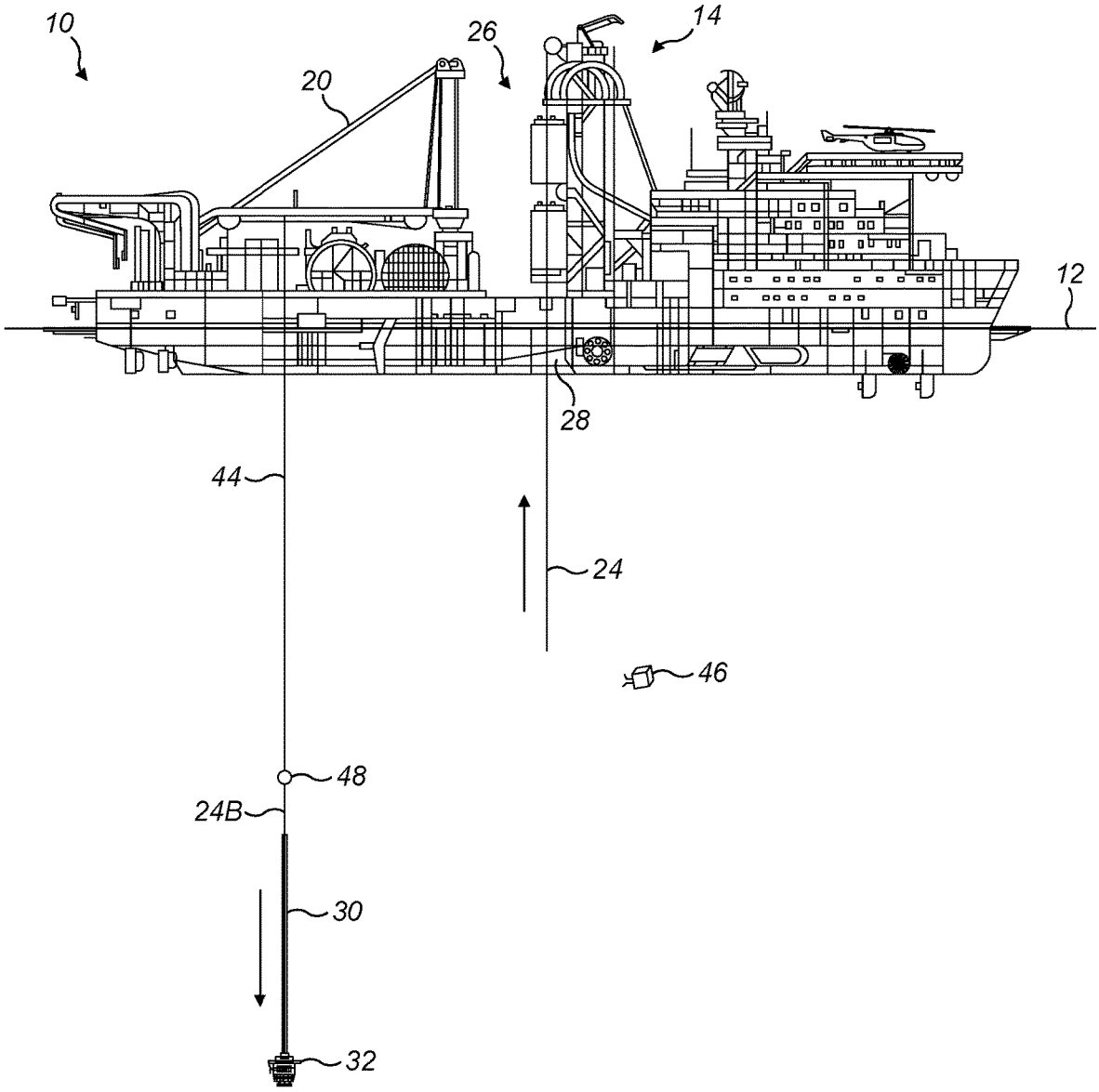
Figure 5A:
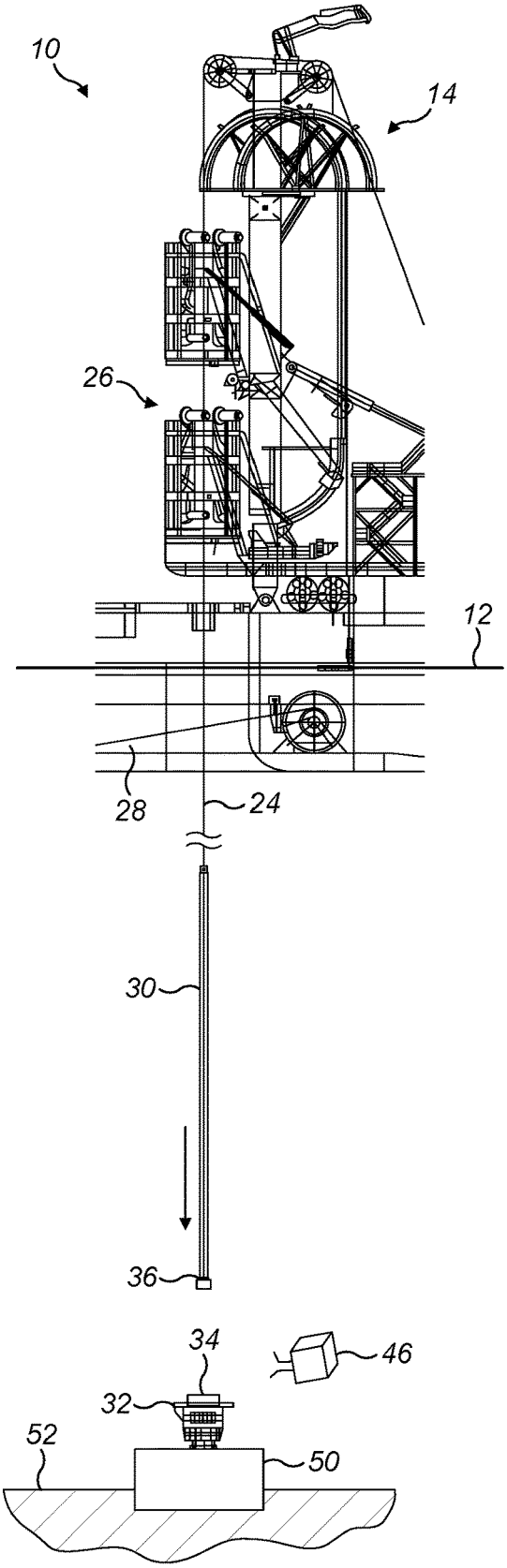
Figure 5B:
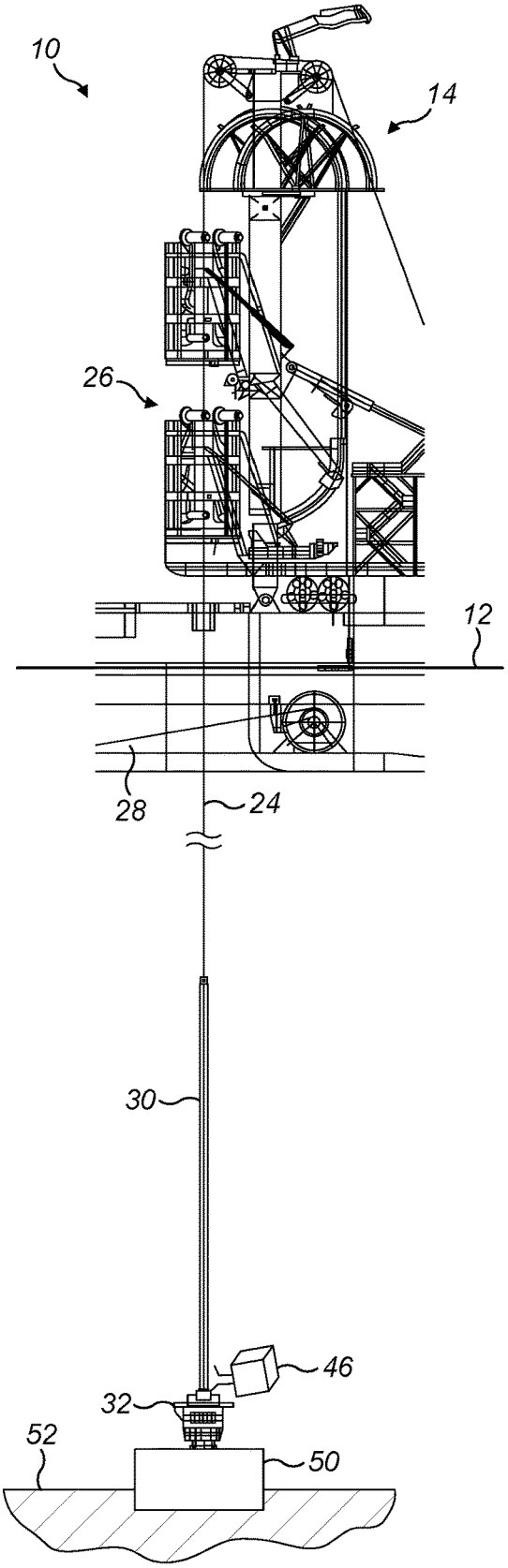
Figure 5C:
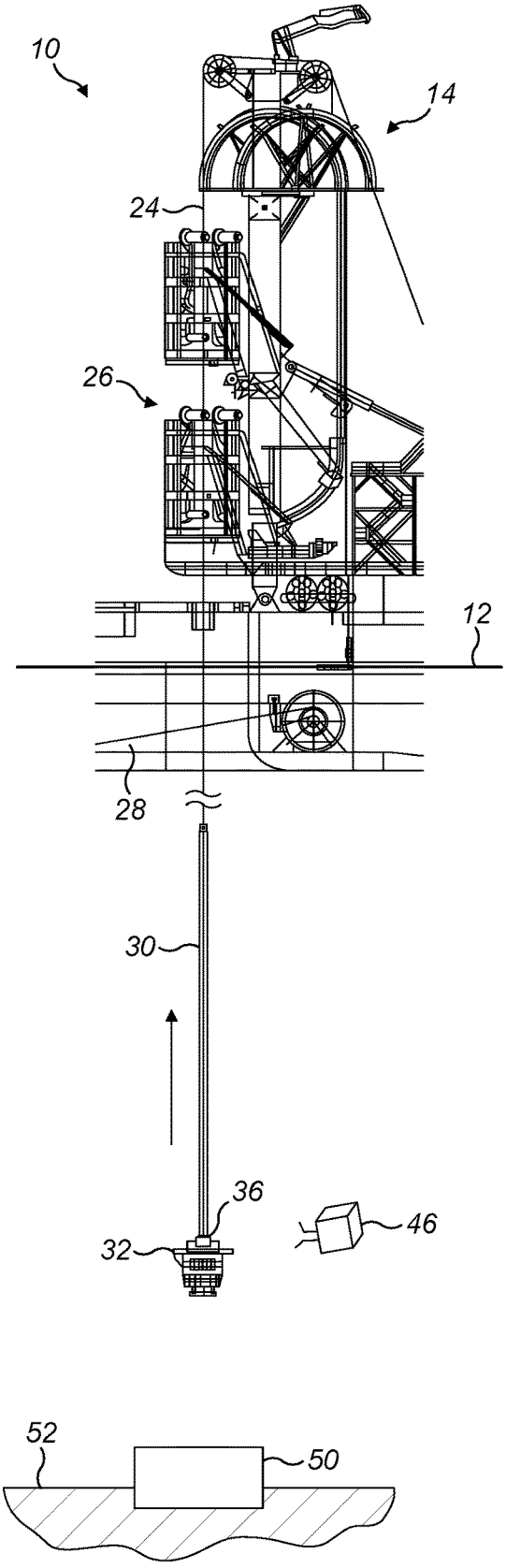
Figure 6C:
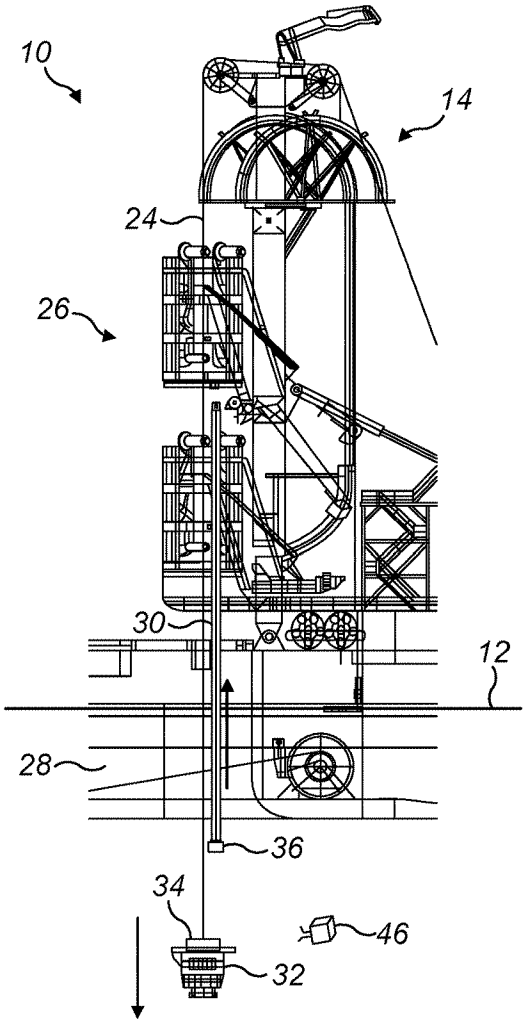
Figure 6B:
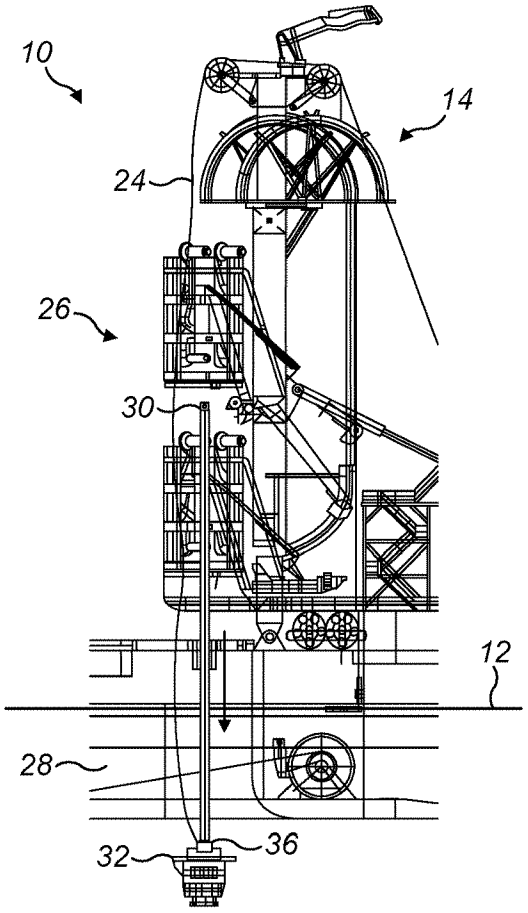
Figure 6A:
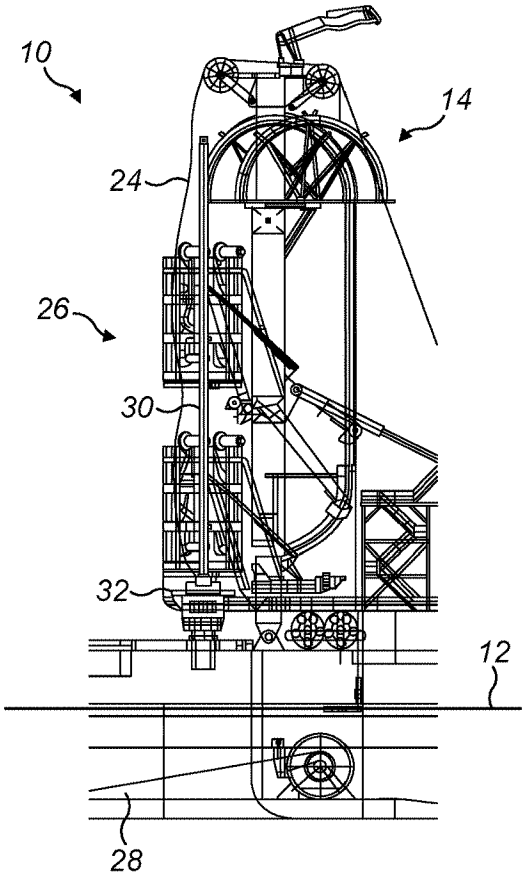
Figure 7:
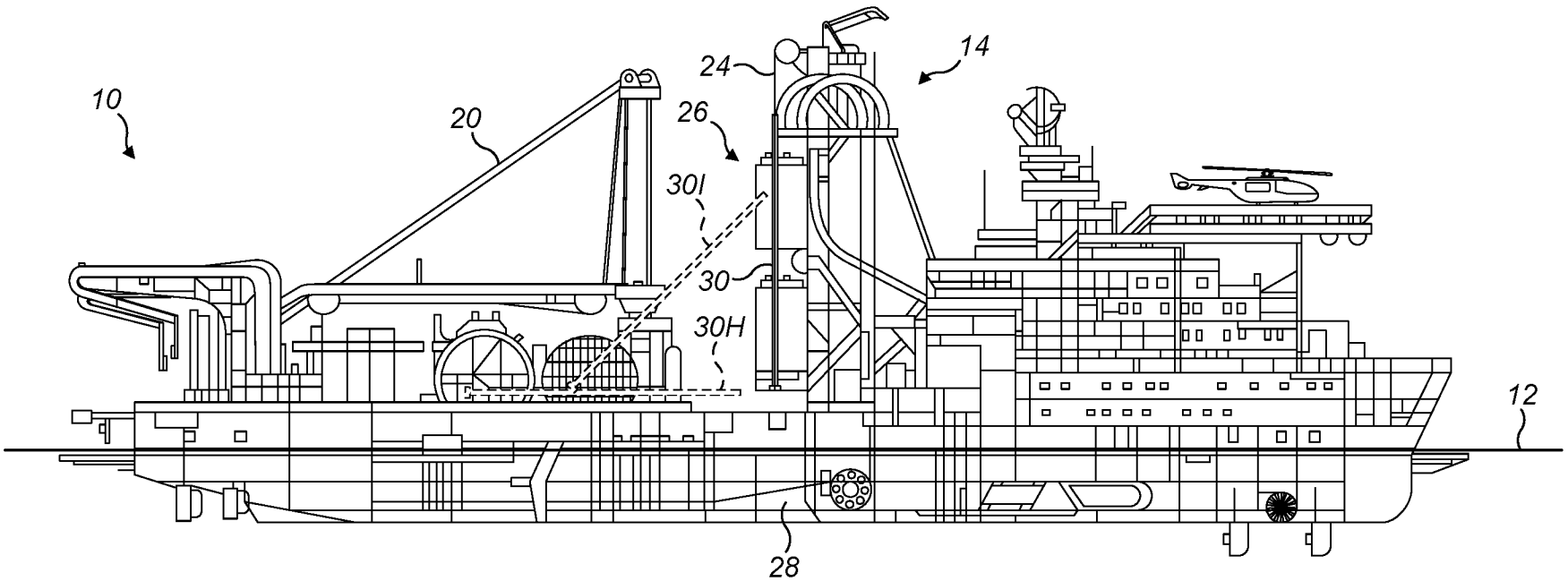

FIGS. 3*a* to 3*d* are a sequence of enlarged side views that show the equipment being attached to the rod and the equipment and the rod then being lowered together beneath the surface of the sea;

FIGS. 4*a* to 4*c* are a sequence of side views that show the combined load of the equipment and the rod being transferred underwater to a main crane of the vessel;

FIGS. 5*a* to 5*c* are a sequence of side views that show the equipment being attached to the rod at a subsea location and the equipment and the rod then being raised together for recovery to the flex-lay vessel;

FIGS. 6*a* to 6*c* are a sequence of side views that show an alternative approach to lowering the equipment into the sea, by detaching the equipment from the rod underwater while the rod remains engaged with a tensioner system of the vessel;

FIG. 7 is a side view of the vessel of FIG. 1 when bringing the rod into an upright orientation, in which the rod is engaged with the tensioner system; and FIGS. 8*a* to 8*d* are a sequence of side views that show an alternative approach to bringing the upright rod into engagement with the tensioner system.

FIG. 1 shows part of a flex-lay vessel 10 floating on the surface 12 of the sea. The vessel 10 is equipped with a vertical lay system (VLS) that comprises an upright ramp or pipelay tower 14 upstanding above a working deck 16 of the hull 18. The pipelay tower 14 can typically be tilted several degrees from the vertical. The hull 18 also supports a main crane 20, which is typically equipped with a heave compensation system.

The pipelay tower 14 is surmounted by a sheave 22 that guides and supports a winch wire 24. The pipelay tower 14 also supports a tensioner system 26 that comprises upper and lower tensioners numbered as 26U and 26L respectively. The tensioners 26U, 26L are retractable but are shown here in a deployed position, aligned on a vertical launch axis. The tensioners 26U, 26L suitably comprise multiple endless tracks.

The launch axis extends through a moonpool 28 that extends vertically through the hull 18 of the vessel 10 from a top opening at the level of the working deck 16 to a bottom opening disposed underwater. A hatch or other equipment support can be deployed over, and retracted from, the top opening of the moonpool 28.

An elongate, rigid and substantially straight column or rod 30 is shown in FIG. 1 extending along the launch axis and engaged with the tensioner system 26. The winch wire 24 hanging from the sheave 22 is removably attached to the upper end of the rod 30 and is kept under tension.

An item of subsea equipment 32 is removably attached to the lower end of the rod 30 and so is suspended from the tensioner system 26 via the rod 30. The equipment 32 that is suspended via the rod 30 is exemplified here by a blowout preventer (BOP). However, the invention may be used with other discrete items of subsea equipment or subsea structures, such as wellheads, Christmas trees or subsea production systems.

Preferably, the attachment between the rod 30 and the equipment 32 is a rigid attachment so that the equipment 32 cannot pivot or swing relative to the rod 30 about a horizontal axis. In the example shown in FIG. 2, the rod 30 and the equipment 32 have complementary engagement formations that comprise an upwardly-facing socket 34 on top of the equipment 32 and a complementary downwardly-facing protrusion or spigot 36 at the lower end of the rod 30. A downwardly-tapering guide funnel 38 suitably surrounds the socket 34 to guide the spigot 36 into the socket 34.

When the spigot 36 is received in the socket 34, a locking mechanism on the rod 30 and/or the equipment 32 is operated to lock the spigot 36 in the socket 34. For example, pawls 40 on the spigot may move radially to engage with latch formations in the socket 34. The pawls 40 may be operated at the surface aboard the vessel 10 or underwater, either to attach the equipment 32 to the rod 30 or to detach the equipment 32 from the rod 30 as appropriate. When operated underwater, the pawls 40 may be operated remotely or by intervention from a diver or an ROV.

Figure 2:
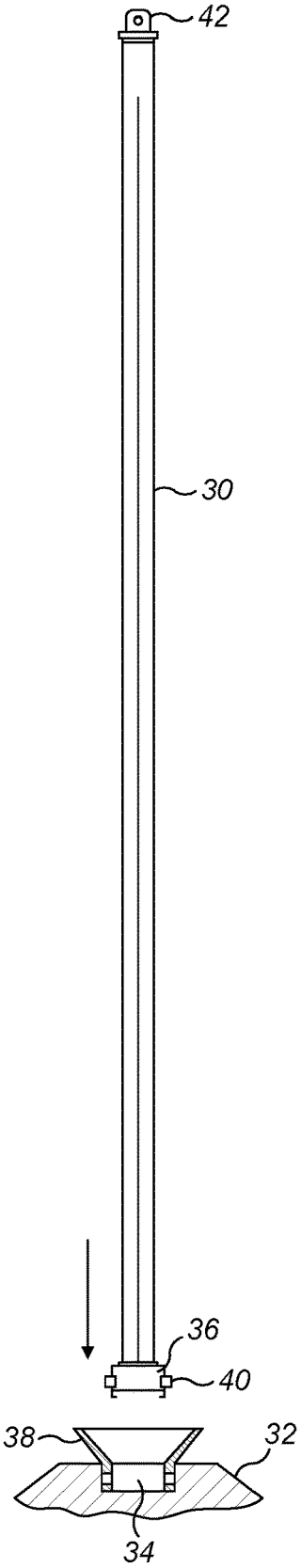
FIG. 2 is an enlarged side view of the rod and equipment shown in FIG. 1.

The upper end of the rod 30 shown in FIG. 2 comprises a padeye coupling 42 for removably attaching the winch wire 24 that hangs from the sheave 22.

The rod 30 shown in FIG. 2 is suitably fabricated from a series or string of tubular rigid pipe joints of steel joined end-to-end, for example by welding. Pipe joints used in the subsea oil and gas industry have a standard length of, nominally, 12 m. Thus, the rod 30 may, for example, comprise a double joint that is 24 m long, a triple joint that is 36 m long or a quad joint that is 48 m long. In any event, the rod 30 is preferably shorter than the pipelay tower 14.

Moving on now to FIGS. 3*a* to 3*d*, this sequence of drawings firstly shows the equipment 32 being attached to the rod 30 and then the equipment 32 and the rod 30 being lowered together through the moonpool 28 and beneath the surface 12 of the sea.

Figure 3A:
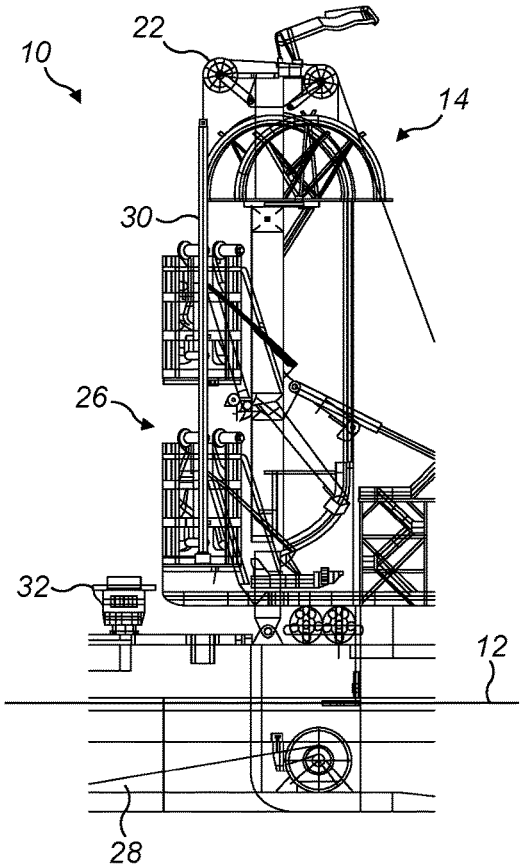

In FIG. 3*a*, the rod 30 is shown engaged with both tensioners 26U, 26L of the deployed tensioner system 26 and extends along the launch axis substantially parallel to the pipelay tower 14. The tensioner system 26 restrains, drives and hence controls axial movement and positioning of the rod 30. At this stage, the tensioner system 26 holds the bottom of the rod 30 clear of the working deck 16 by a vertical distance that is sufficient to accommodate the height of the equipment 32.

Initially, the equipment 32 is shown supported on the working deck 16 to one side of the rod 30 and hence offset laterally with respect to the launch axis. Specifically, the equipment 32 is supported on a structure that is movable horizontally relative to the working deck 16, such as on a skid or on a hatch that is deployable over the top opening of the moonpool 28.

Figure 3B:
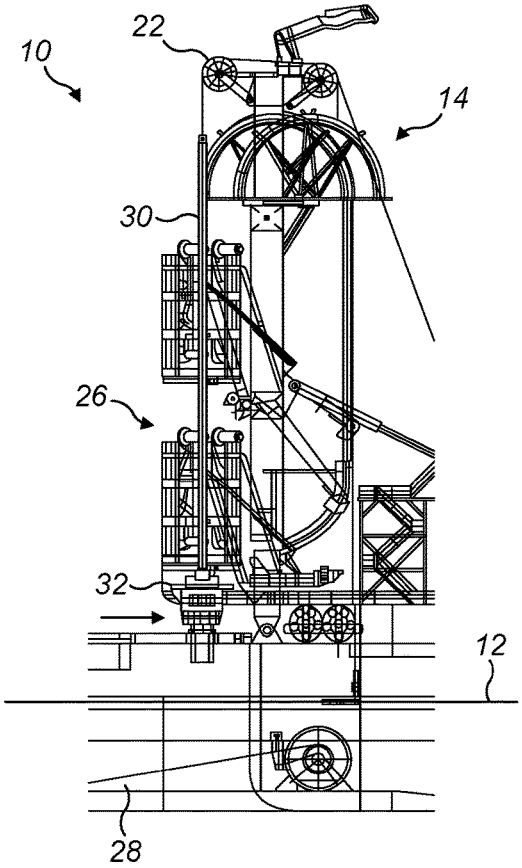

FIG. 3*b* shows the equipment 32 now moved horizontally relative to the working deck 16 to be brought into alignment with the launch axis, directly beneath the rod 30. The rod 30 is then lowered slightly to bring the spigot 36 at the bottom of the rod into engagement with the socket 34 on top of the equipment 32. The pawls 40 shown in FIG. 2 are then actuated to lock the spigot 36 in the socket 34 and hence to connect the equipment 32 rigidly to the rod 30.

When the equipment 32 has been connected to the rod 30 in this way, the tensioner system 26 lifts the assembly of the rod 30 and the equipment 32 slightly away from the working deck 16 to allow a skid or hatch that previously supported the equipment 32 to be retracted away from over the moonpool 28.

Figure 3C:
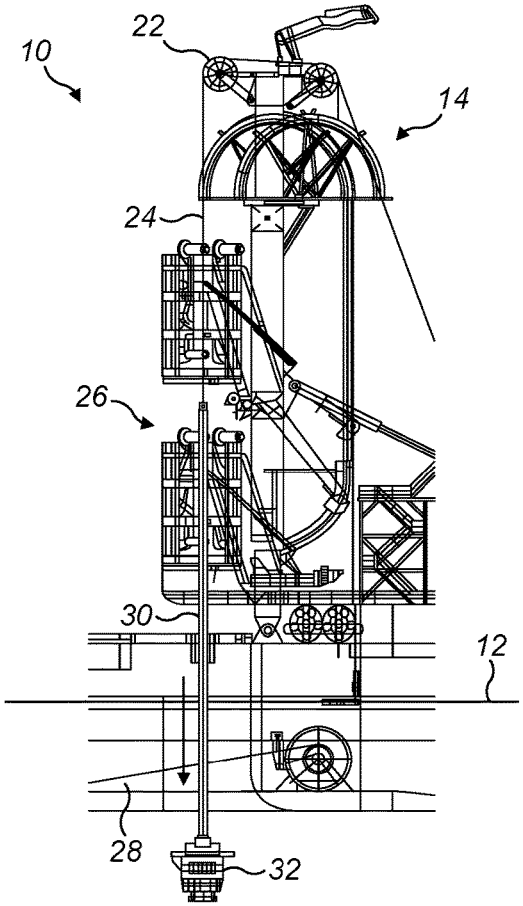

The rod 30 and the equipment 32 are now ready to be lowered into the moonpool 28 as shown in FIG. 3*c* and also in FIG. 1. Here, the rod 30 has disengaged from the upper tensioner 26U and remains engaged only with the lower tensioner 26L. As a result, the rod 30 extends beneath the surface 12 within the moonpool 28 to the extent that the equipment 32 is suspended beneath the hull 18 of the vessel 10 and so is fully submerged.

The stiffness of the rod 30 and its non-pivoting engagement with the tensioner system 26 controls the position of the equipment 32 effectively during the launch operation. In particular, the resistance of the rod 30 to bending along its length keeps the equipment 32 substantially on the desired launch axis and clear from the surrounding walls of the moonpool 28. Thus, there is no risk of clashing with the hull 18 of the vessel 10 as the equipment 32 transits the splash zone beneath the surface 12. Also, the resistance of the rod 30 to compression and extension along its length resists the tendency of wave action to bounce the equipment 32 up and down during its transit through the splash zone.

Figure 3D:
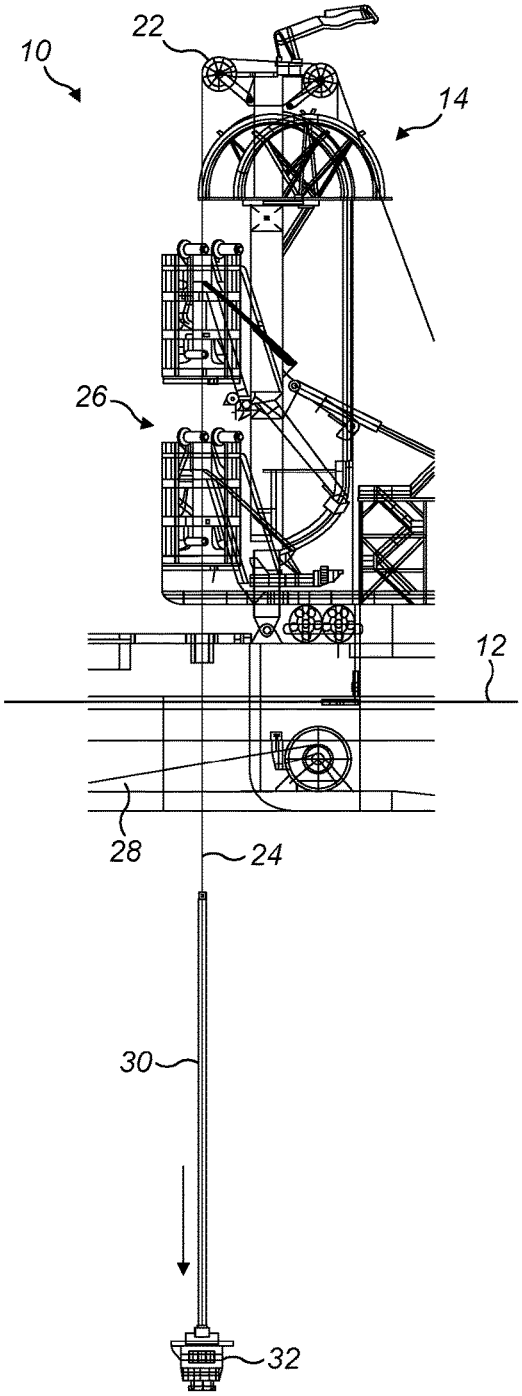

FIG. 3*d* shows the assembly of the rod 30 and the equipment 32 now lowered fully beneath the surface 12. The rod 30 has disengaged fully from the tensioner system 26 and so is suspended solely by the winch wire 24 that hangs from the sheave 22. Whilst the rod 30 no longer provides the lateral location for the equipment 32 that is evident in FIG. 3*c*, it will be apparent that the equipment 32 is now fully beneath the splash zone and so is no longer susceptible to disturbance from wave action.

In FIGS. 3*a* and 3*b*, the winch wire 24 has not yet been attached to the top of the rod 30 via the padeye coupling 42. However, it would be possible to suspend the rod 30 from the winch wire 24 instead of from the tensioner system 26 when attaching the equipment to the rod 30 as shown in FIGS. 3*a* and 3*b*. Thus, the tensioner system 26 need not be engaged with the rod 30 until after the equipment 32 has been attached to the rod 30 and the resulting assembly is ready to be launched into the sea as shown in FIGS. 3*c* and 3*d*.

In principle, the winch wire 24 could be attached to the top of the rod 30 at any stage before the rod 30 passes through the tensioner system 26 and disengages from the lower tensioner 26L. In practice, however, the winch wire 24 should preferably be attached to the top of the rod 30 as a failsafe measure before the support of a skid or hatch over the moonpool 28 is removed from the equipment 32.

In shallow water, the winch wire 24 could continue to be paid out to lower the assembly of the rod 30 and the equipment 32 all the way to the seabed. There, the equipment 32 can be landed at a target location, such as on top of a subsea wellhead. Then, the rod 30 can be detached from the equipment 32, for example by retracting the pawls 40 shown in FIG. 2, to deposit the equipment 32 before the rod 30 is winched back to the pipelay tower 14 through the moonpool 28 of the vessel 10. The rod 30 can then be used again to launch or to retrieve other equipment or can be removed from the pipelay tower 14 and stowed on the working deck 16 of the vessel 10.

Optionally, in deeper water, the load defined by the assembly of the rod 30 and the equipment 32 may be transferred underwater to the main crane 20 before that assembly is lowered further toward the seabed. One such transfer process is shown in FIGS. 4*a* to 4*c* and will now be described.

FIG. 4*a* shows a lifting wire 44 that is suspended from the main crane 20. A lower end of the lifting wire 44 is shown here being carried by an ROV 46 toward the winch wire 24 that suspends the rod 30 and the equipment 32 from the sheave 22 on the pipelay tower 20.

FIG. 4*b* shows the lifting wire 44 now attached to the winch wire 24 by the ROV 46. The lifting wire 44 is attached to the winch wire 24 at an intermediate coupling 48 above a short bottom portion 24B of the winch wire 24 that connects to the top of the rod 30.

FIG. 4*c* shows a major portion of the winch wire 24 above the intermediate coupling 48 now detached from the lifting wire 44 by the ROV 46 and being raised back to the vessel 10. The rod 30 remains attached to the lifting wire 44 via the bottom portion 24B of the winch wire 24. The load of the rod 30 and the equipment 32 has now been transferred to the main crane 20, which pays out the lifting wire 44 to lower that assembly toward the seabed as shown in FIG. 4*c*.

Again, once the equipment 32 has been landed at a target location on the seabed, the rod 30 is detached from the equipment 32 and lifted back to the vessel 10. The rod 30 can be transferred to the winch wire 24 underwater to be lifted back into the pipelay tower 14 for re-use; alternatively, the main crane 20 can stow the rod 30 on the working deck 16.

The inventive concept can also be applied to the recovery of equipment 32 from a subsea location. This is achieved by lowering a rod 30 to the subsea location and then coupling the rod 30 to the equipment 32 at that location before recovering the rod 30 and the equipment 32 together to the vessel 10.

In this respect, FIGS. 5*a* to 5*c* show equipment 32 in the form of a BOP atop a subsea wellhead 50 on the seabed 52. FIG. 5*a* shows the rod 30 suspended on a winch wire 24 and being lowered toward the equipment 32. FIG. 5*b* shows the spigot 36 at the lower end of the rod 30 being engaged with the socket 34 on top of the equipment 32 with the assistance of an ROV 46. Once the rod 30 has been locked to the equipment 32 in this way, the equipment 32 can be detached from the wellhead 50 and then pulled back up toward the surface 12 while being suspended from the rod 34 and the winch wire 24 as shown in FIG. 5*c*.

It will be apparent that when the top end of the rod 34 is pulled up through the moonpool 28 and engaged with the tensioner system 26, the system returns to the state shown in FIG. 1 and in FIG. 3*c*. So, again, the stiffness of the rod 30 beneficially guides and stabilises the movement of the equipment 32 through the turbulent splash zone beneath the surface 12, in this case in an upward direction, until the equipment 32 clears the surface 12 before reaching the level of the working deck 16.

As in FIGS. 4*a* to 4*c*, the rod 30 could be suspended from the lifting wire 44 of the main crane 20 instead of from the winch wire 24 when recovering the rod 30 and the equipment 32 to the vessel 10. In that case, the load of the rod 30 and the equipment 32 could be transferred underwater from the lifting wire 44 to the winch wire 24 in a reversal of the process shown in FIGS. 4*a* to 4*c*.

FIGS. 6*a* to 6*c* show a second embodiment of the invention, in which like numerals are used for like features. In this variant, the rod 30 is attached to the equipment 32 in the same way as in the preceding embodiment. For example, pawls 40 may be actuated to lock the spigot 36 of the rod 30 in the socket 34 of the equipment 32 as shown in FIG. 2.

However, the winch wire 24 is attached directly to the equipment 32 rather than to the rod 30. Consequently, there is the option for the winch wire 24 to remain slack while the rod 30 that suspends the equipment 32 is clamped by and advanced through the tensioner system 26, as shown in FIGS. 6*a* and 6*b*.

Once the equipment 32 has safely transited the splash zone beneath the surface 12, the winch wire 24 is made taut if necessary and then the equipment 32 is detached from the rod 30 as shown in FIG. 6*c*. For example, an ROV 46 may retract the pawls 40 that lock the spigot 36 into the socket 34 as shown in FIG. 2. This transfers the load of the equipment 32 from the rod 30 to the winch wire 24.

FIG. 6*c* shows that the equipment 32 may now be lowered away from the lower end of the rod 30. As mentioned previously, the equipment 32 could be lowered to the seabed on the winch wire 24 or its load could be transferred underwater to the lifting wire 44 of the main crane 20 as described in FIGS. 4*a* to 4*c*.

The rod 30 remains engaged with the tensioner system 26 and so can be lifted back up beside the pipelay tower 14 by reversing the drive direction of the tensioner system 26. The rod 30 can then be used again to launch or to recover other equipment or can be removed from the pipelay tower 14 and laid onto the working deck 16 of the vessel 10 for storage.

It will be apparent that the principles of the second embodiment may also be applied to recovery of equipment 32 from a subsea location, such as the subsea wellhead 50 shown in FIGS. 5*a* to 5*c*. In this case, the rod 34 may be held by the tensioner system 26 with its lower end underwater, beneath the splash zone. The equipment 32 may then be raised on the winch wire 24 to be coupled to the lower end of the rod 34, before the tensioner system 26 lifts the rod 30 and the equipment 32 together out of the water.

It would also be possible to raise the equipment 32 from a subsea location on the lifting wire 44 of the main crane 20 and then to transfer the equipment 32 underwater to the winch wire 24 before uniting the equipment 32 with the rod 30.

Turning finally to FIG. 7 and FIGS. 8*a* to 8*d*, these drawings show ways of moving the rod 30 from a stowed position lying on the working deck 16 of the vessel 10 into an upright orientation engaged with the tensioner system 26 of the pipelay tower 14.

In FIG. 7, the rod 30 is lifted from a horizontal position 32H through an intermediate position 32I, both shown in dashed lines, and into the vertical position shown in solid lines. Conveniently, the winch wire 24 hanging from the sheave 22 may be used to pull the rod 30 upright, optionally with assistance from the main crane 20 or another service crane of the vessel 10.

The sequence of drawings in FIGS. 8*a* to 8*d* shows another approach, which involves lowering the rod 30 into the sea and uniting the rod 30 with the winch wire 24 underwater. The winch wire 24 is then wound in to pull the rod 30 back above the surface 12 and into engagement with the tensioner system 26.

Figure 8A:
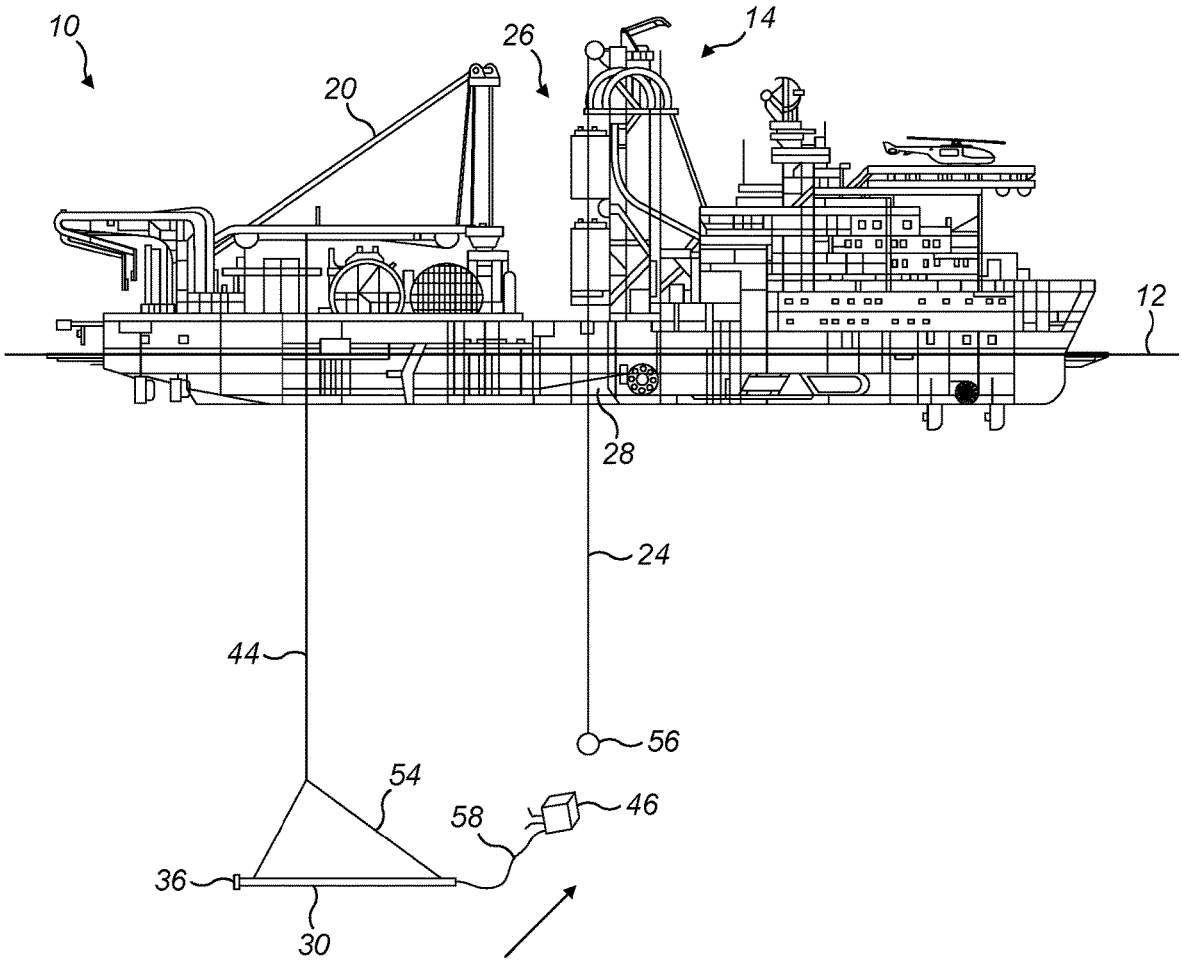
Figure 8B:
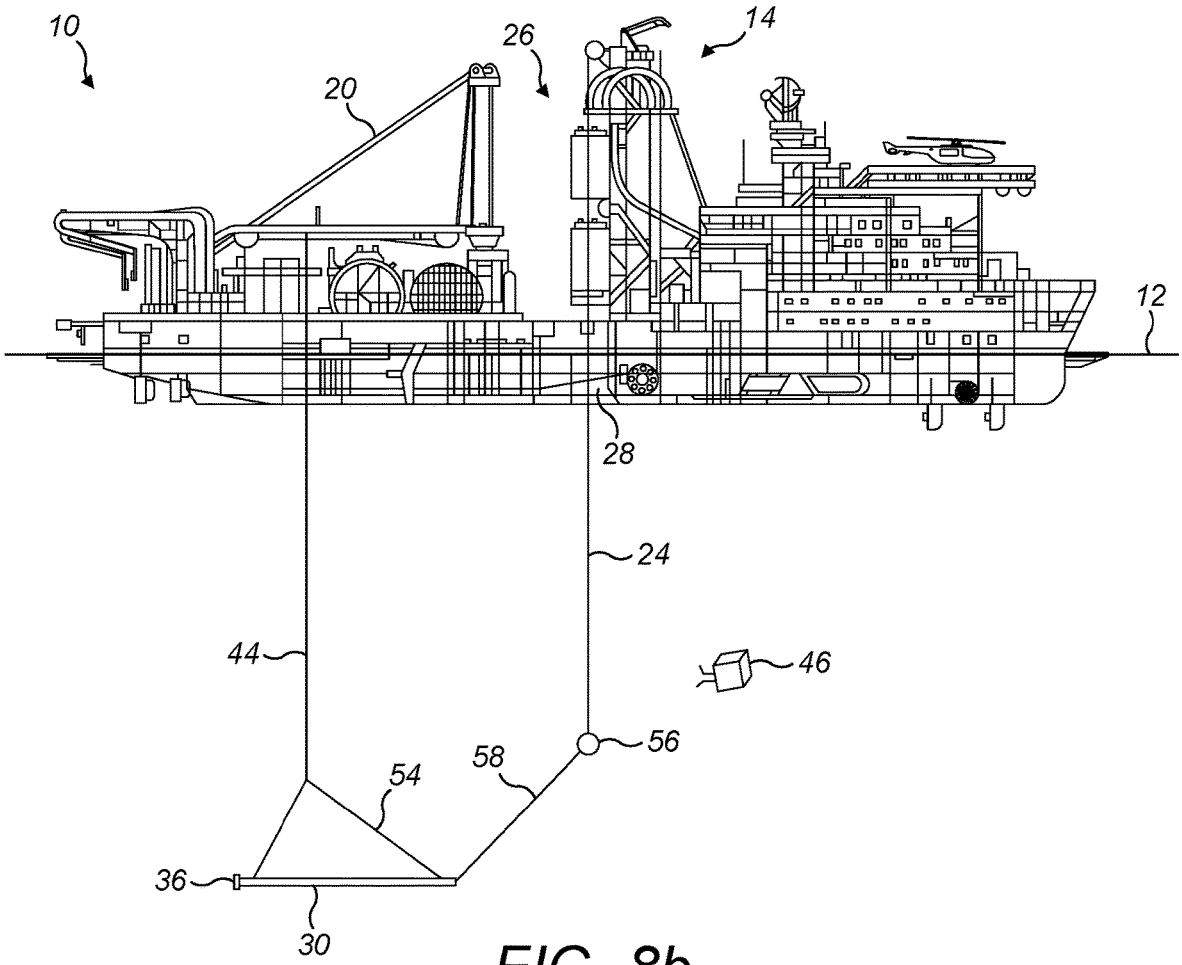

In FIG. 8*a*, the rod 30 has been lifted from the working deck 16 and lowered over the side of the vessel 10 to a location under the surface 12 of the sea, at a depth beneath the influence of wave action. Initially, the rod 30 is supported by rigging 54 that is suspended from the lifting wire 44 of the main crane 20. The rod 30 remains in a substantially horizontal orientation at this stage. The winch wire 24 extends through the moonpool 28 to hang underwater close to the rod 30. A coupling 56 hangs at the bottom end of the winch wire 24.

FIG. 8*a* shows an ROV 46 carrying a connecting line 58 from an end of the rod 30 to the coupling 56 at the nearby bottom end of the winch wire 24. The connecting line 58 is shown attached to the coupling 56 in FIG. 8*b*. The winch wire 24 is then pulled upwardly as shown in FIG. 8*c* to transfer the load of the rod 30 from the lifting wire 44 to the winch wire 24 via the connecting line 58.

Figure 8C:
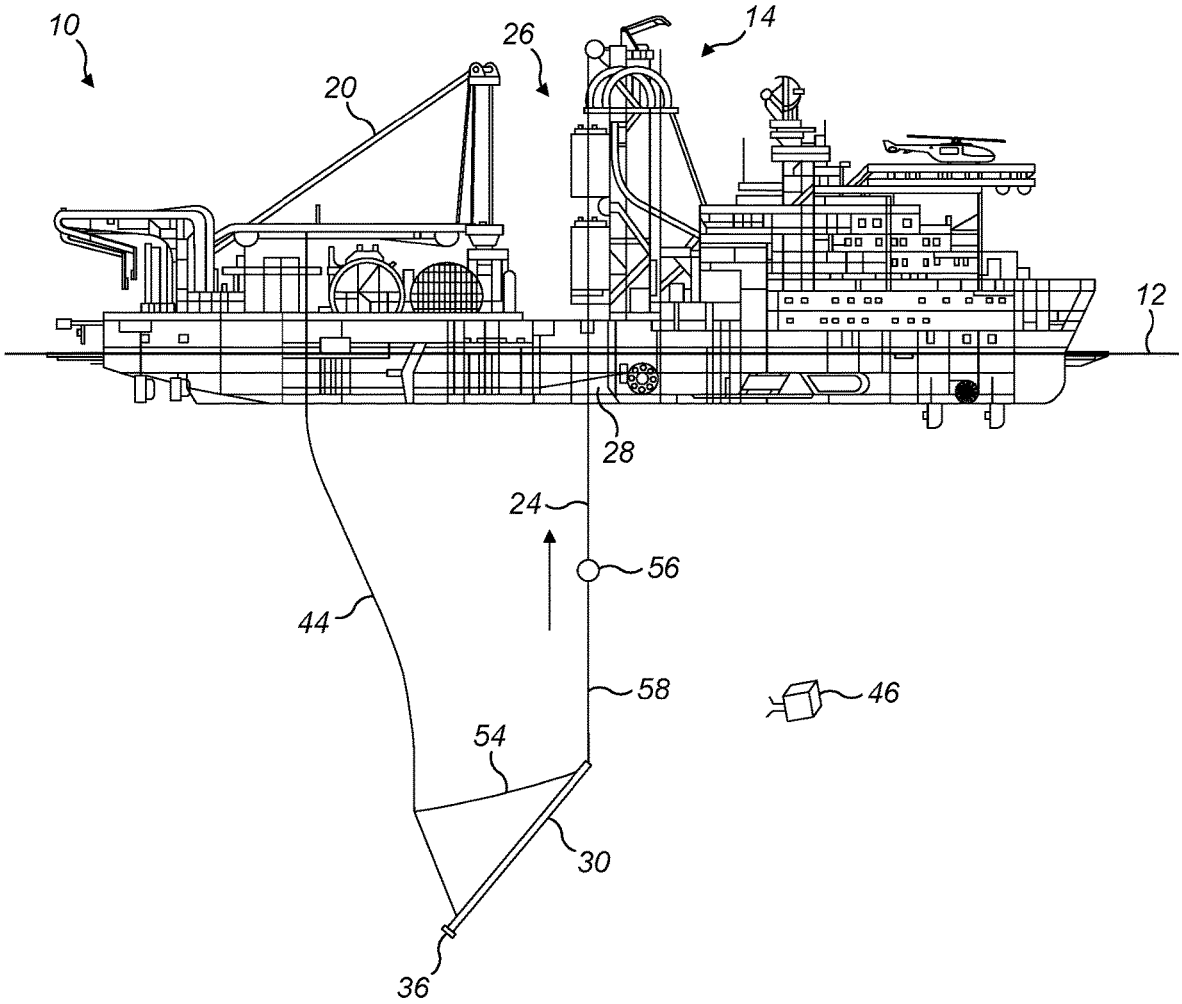

FIG. 8*c* shows the rod 30 tilting toward a vertical orientation under the upward pull of the winch wire 24. FIG. 8*c* also shows the lifting wire 44 and the rigging 54 going slack as the load of the rod 30 is transferred to the winch wire 24.

Figure 8D:
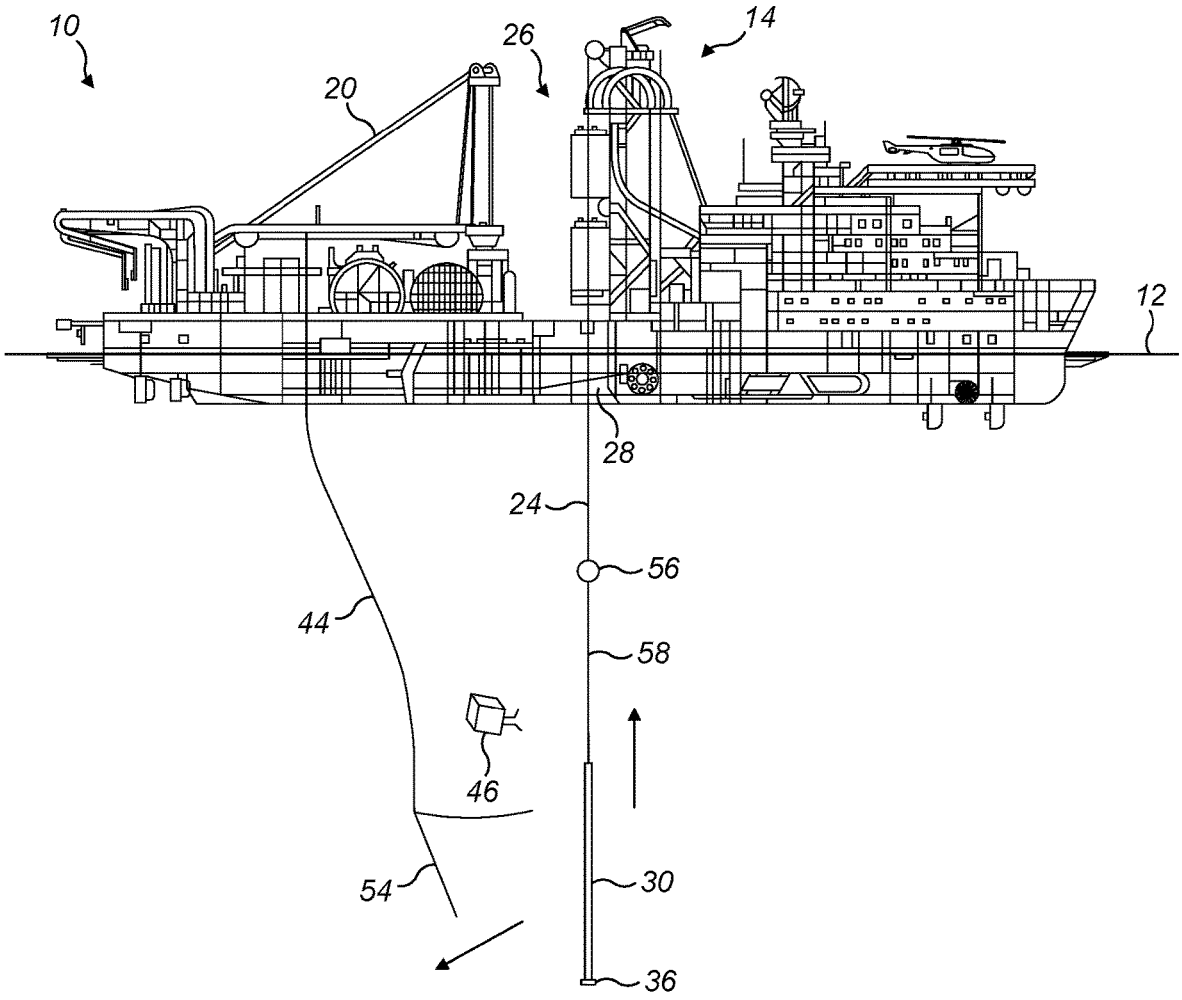

When the rod 30 is substantially vertical, the ROV 46 disconnects the rigging 54 from the rod 30 as shown in FIG. 8*d*. The main crane 20 can then recover the rigging 54 to the vessel 10 by winding in the lifting wire 44. The winch wire 24 is also wound in to pull the rod 30 up through the moonpool 28 and into alignment and engagement with the tensioner system 26 of the pipelay tower 14.

Many other variations are possible within the inventive concept. For example, the use of a moonpool is optional; it would be possible instead for the launch axis to lie outboard of the vessel so that the equipment can be launched to either side of the vessel.

Various inter-engagement arrangements are possible instead of a spigot on the rod and a socket on the equipment to be supported by the rod. For example, the arrangement could be reversed so that a male formation on the equipment engages into a female formation on the rod. Similarly, pawls or other locking provisions that lock the equipment to the rod could be provided on the equipment rather than on the rod.

Whilst it is preferred for the rod to be tubular and it is convenient for the rod to be formed of a series of steel pipe joints welded or otherwise joined end-to-end, this is not essential. For example, the rod could be solid, could be made from a single piece of material, or could be made of a polymer composite or other material that is different to steel.

It is preferred for the rod to be moved from the stowed position into an operational position and back again as a single integral unit. However, the rod could instead be assembled and disassembled from shorter sections in the pipelay tower. The sections could, for example, have threaded end joints for this purpose.

The invention claimed is:

1. A method of lowering a load from a pipelay vessel on the surface of a body of water, the method comprising:

holding a rigid rod on an upright launch axis, extending through a hold back system on a pipelay tower of the vessel;

mechanically coupling a lower end of the rod to the load;

above the surface, connecting a wire to the load indirectly via the rod to suspend the load from the wire via the rod;

operating the hold back system to advance the rod downwardly relative to the pipelay tower, submerging the load, while the weight of the load is suspended from the hold back system via the rod;

when the load reaches a predetermined depth underwater, transferring the weight of the load from the hold back system to the wire;

continuing to lower the load in the water, suspended from the wire;

detaching the rod from the load when the load has been lowered to a subsea location; and recovering the detached rod to the vessel by winding in the wire.

2. The method of claim 1, comprising lifting the detached rod back to a position in which the rod extends through the hold back system.

3. The method of claim 1, comprising rigidly coupling the rod to the load.

4. The method of claim 1, comprising using the hold back system to hold the rod on the upright launch axis before coupling the rod to the load.

5. The method of claim 4, comprising operating the hold back system to advance the rod toward the load for coupling the lower end of the rod to the load.

6. The method of claim 1, comprising moving the load transversely relative to the launch axis before coupling the lower end of the rod to the load.

7. The method of claim 6, comprising supporting the load on a skid or on a moonpool hatch that is movable relative to a deck of the vessel.

8. The method of claim 1, comprising connecting the wire to the load before operating the hold back system to advance the rod.

9. The method of claim 1, further comprising transferring the weight of the load from the wire to a secondary wire when the load is underwater.

10. The method of claim 1, comprising tensioning the wire while the rod is held by the hold back system.

11. The method of claim 10, wherein the tensioned wire extends substantially parallel to the launch axis.

12. The method of claim 11, wherein the tensioned wire extends substantially along the launch axis.

13. The method of claim 1, performed using a flex lay vessel.

14. The method of claim 1, wherein the launch axis extends through a moonpool of the vessel.

15. The method of claim 1, preceded by moving the rod from a stowed position to a ready position extending through the hold back system along the upright launch axis.

16. The method of claim 15, comprising tilting the rod into an upright orientation by lifting an end of the rod from a working deck of the vessel.

17. The method of claim 15, wherein moving the rod from the stowed position to the ready position comprises:

lowering the rod into the water;

connecting the wire to an end of the rod underwater; and winding in the wire to lift the rod into the ready position.

18. The method of claim 1, wherein the hold back system is a tensioner system that is operated by turning endless tracks that engage the rod.

19. The method of claim 1, wherein the hold back system comprises a friction clamp able to travel along the pipelay tower, wherein the clamp engages the rod by friction.

20. A method of lowering a load from a pipelay vessel on the surface of a body of water, the method comprising:

holding a rigid rod on an upright launch axis, extending through a hold back system on a pipelay tower of the vessel;

mechanically coupling a lower end of the rod to the load;

above the surface, connecting a wire to the load directly;

operating the hold back system to advance the rod downwardly relative to the pipelay tower, submerging the load, while the weight of the load is suspended from the hold back system via the rod;

when the load reaches a predetermined depth underwater, transferring the weight of the load from the hold back system to the wire by detaching the load from the rod while the rod is held by the hold back system; and continuing to lower the load in the water, suspended from the wire to a subsea location.

21. The method of claim 20, comprising operating the hold back system to retract the detached rod upwardly relative to the pipelay tower.

22. A method of recovering a load from a subsea location to a pipelay vessel on the surface of the sea, the method comprising:

initially suspending a rigid rod underwater on a wire suspended from the vessel and mechanically coupling the rod to the load at the subsea location;

winding in the wire suspended from the vessel to lift the rigid rod that is attached to the wire and mechanically coupled to the load to a position extending through a hold back system on a pipelay tower of the vessel;

when the load is underwater, engaging the hold back system with the rod to transfer the weight of the load from the wire to the hold back system; and operating the hold back system to retract the rod upwardly relative to the pipelay tower, lifting the load above the surface, while the weight of the load is suspended from the hold back system via the rod.

23. A method of recovering a load from a subsea location to a pipelay vessel on the surface of the sea, the method comprising:

winding in a wire suspended from the vessel to lift a load attached directly to the wire toward the vessel from the subsea location;

underwater, transferring at least part of the weight of the load from the wire to a hold back system on a pipelay tower of the vessel by mechanically coupling the load to a lower end of a rigid rod that is engaged with the hold back system; and operating the hold back system to retract the rod upwardly relative to the pipelay tower, lifting the load above the surface, while at least part of the weight of the load is suspended from the hold back system via the rod.

24. The method of claim 23, preceded by attaching the wire to the load at the subsea location.

25. The method of claim 23, preceded by transferring the weight of the load to the wire, underwater, from a secondary wire used to raise the load from the subsea location.

26. The method of claim 23, wherein the wire extends through the hold back system.

27. The method of claim 23, further comprising detaching the wire from the rod or the load aboard the vessel.

28. The method of claim 23, further comprising detaching the load from the rod aboard the vessel.

29. The method of claim 23, further comprising removing the rod from the pipelay tower and stowing the rod.

* * * * *